US006798393B2

(12) United States Patent
Honda et al.

(10) Patent No.: US 6,798,393 B2
(45) Date of Patent: Sep. 28, 2004

(54) PLASMA DISPLAY DEVICE

(75) Inventors: Hirofumi Honda, Yamanashi (JP); Tetsuya Shigeta, Yamanashi (JP); Tetsuro Nagakubo, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 346 days.

(21) Appl. No.: 09/894,834

(22) Filed: Jun. 29, 2001

(65) Prior Publication Data

US 2002/0021263 A1 Feb. 21, 2002

(30) Foreign Application Priority Data

Jun. 30, 2000 (JP) ..... 2000-199899

(51) Int. Cl.[7] ..... G09G 3/28
(52) U.S. Cl. ..... 345/60; 345/63
(58) Field of Search ..... 345/60, 61, 62, 345/63, 68, 87, 89, 98, 100, 690, 691, 692; 315/169.1, 169.4; 348/625

(56) References Cited

U.S. PATENT DOCUMENTS 6,297,854 B1 * 10/2001 Suzuki et al. ..... 348/625
6,465,970 B2 * 10/2002 Nagakubo et al. ..... 315/169.4
6,496,165 B1 * 12/2002 Ide et al. ..... 345/60
6,535,224 B2 * 3/2003 Kuriyama et al. ..... 345/690
6,552,736 B2 * 4/2003 Honda et al. ..... 345/691

* cited by examiner

*Primary Examiner*—Regina Liang
*Assistant Examiner*—Jennifer T. Nguyen
(74) *Attorney, Agent, or Firm*—Sughrue Mion, PLLC

(57) ABSTRACT

A plasma display device capable of providing high luminance display. In each subfield, a non-selected line on which all the discharge cells are not subjected to selective discharge is detected, and pixel data writing scanning is performed only to display lines excluding such non-selected lines.

2 Claims, 9 Drawing Sheets

FIG. 7

| GRADATION | PIXEL DATA | LIGHT EMISSION PATTERN | | | |
|---|---|---|---|---|---|
| | | SF1 | SF2 | SF3 | SF4 |
| 1 | 1 1 1 1 | ● | ● | ● | ● |
| 2 | 0 1 1 1 | ○ | ● | ● | ● |
| 3 | 1 0 1 1 | ● | ○ | ● | ● |
| 4 | 0 0 1 1 | ○ | ○ | ● | ● |
| 5 | 1 1 0 1 | ● | ● | ○ | ● |
| 6 | 0 1 0 1 | ○ | ● | ○ | ● |
| 7 | 1 0 0 1 | ● | ○ | ○ | ● |
| 8 | 0 0 0 1 | ○ | ○ | ○ | ● |
| 9 | 1 1 1 0 | ● | ● | ● | ○ |
| 10 | 0 1 1 0 | ○ | ● | ● | ○ |
| 11 | 1 0 1 0 | ● | ○ | ● | ○ |
| 12 | 0 0 1 0 | ○ | ○ | ● | ○ |
| 13 | 1 1 0 0 | ● | ● | ○ | ○ |
| 14 | 0 1 0 0 | ○ | ● | ○ | ○ |
| 15 | 1 0 0 0 | ● | ○ | ○ | ○ |
| 16 | 0 0 0 0 | ○ | ○ | ○ | ○ |

○ LIGHT EMITTING

● NON-LIGHT EMITTING

PLASMA DISPLAY DEVICE

BACKGROUND OF THE INVENTION

1. Field of the Invention

The present invention relates to plasma display devices.

2. Description of Related Art

In recent years, as the size of display devices has increased, there has been a demand for a thinner display device, and consequently various thin display devices have become commercially available. The AC (alternating current discharge) type plasma display panel (hereinafter simply as "PDP"), a thin display device, has attracted much attention.

The PDP includes a matrix of discharge cells corresponding to pixels. The discharge cell is allowed to emit light by the discharge phenomenon. There are only two states for the cell, i.e., the "light emitting" state in the maximum luminance and the "non-light emitting" state in the minimum luminance. Gradation driving is performed based on a subfield drive method in order to allow the discharge cell to display the intermediate level luminance corresponding to an input video signal.

In the gradation driving based on the subfield drive method, one field in a display period consists of a plurality of subfields, and each subfield is allocated with a light emission number (light emitting periods) corresponding to the weight of the subfield.

FIG. 1 is a diagram showing a light emission driving format when one field in the display period is divided into four subfields, SF1 to SF4.

In FIG. 1, the subfields SF1 to SF4 are allocated the light emission numbers as follows:

SF1: 1

SF2: 2

SF3: 4

SF4: 8

Depending upon the luminance level of an input video signal, light is emitted in one or a combination of the subfields SF1 to SF4. If for example the luminance level of the input video signal is "4", only the subfield SF3 among the subfields SF1 to SF4 is used for emitting light. At the time, light is emitted four times in the subfield SF3. Therefore, light emission is performed four times during the display period for one field, and the luminance corresponding to the luminance level "4" is observed. If the luminance level of the input video signal is "13", light emission is performed in the subfields SF1, SF2 and SF4. At the time, light emission is performed once in the subfield SF1, twice in the subfield SF2, and eight times in the subfield SF4. Therefore, light emission is performed thirteen times altogether during the display period for one field, and the luminance corresponding to the luminance level "13" is observed.

In this case, in order to increase the luminance of the entire screen, the number of light emission (light emitting periods) allocated to each subfield may be increased. However, the display period for one field is limited, and therefore such a method will not improve the luminance as desired.

SUMMARY OF THE INVENTION

It is an object of the present invention to provide a plasma display device capable of high luminance display by gradation driving according to the subfield drive method.

A plasma display device, according to the present invention, performs gradation driving to a plasma display panel based on a video signal. The plasma display panel has discharge cells formed at the intersections of a plurality of row electrodes corresponding to display lines and a plurality of column electrodes arranged so that they intersect the row electrodes. The plasma display device includes a driving portion and a non-selected line detection portion. The driving portion performs pixel data writing scanning for scanning each of the discharge cells on each display line according to pixel data corresponding to the video signal, and causes selective discharge. As a result this sets each of the discharge cells to one of a light emitting state and a non-light emitting state in each of a plurality of subfields constituting a display period for one field in the video signal. The driving portion also performs light emission sustaining driving for causing sustaining discharge. As a result this allows only the discharge cells in the light emitting state to emit light as many times as the number of light emissions allocated corresponding to the weight of each subfield. The non-selected line detection portion detects a non-selected line to be a display line on which all the discharge cells are not subjected to the selective discharge based on the pixel data. The driving portion performs the pixel data writing scanning only to each of the display lines excluding the non-selected line.

BRIEF DESCRIPTION OF THE DRAWINGS

FIG. 7 is a table of light emission patterns for pixel data PD;

DETAILED DESCRIPTION OF THE PREFERRED EMBODIMENTS

Embodiments of the present invention will be now described in conjunction with the accompanying drawings.

Figure 2:
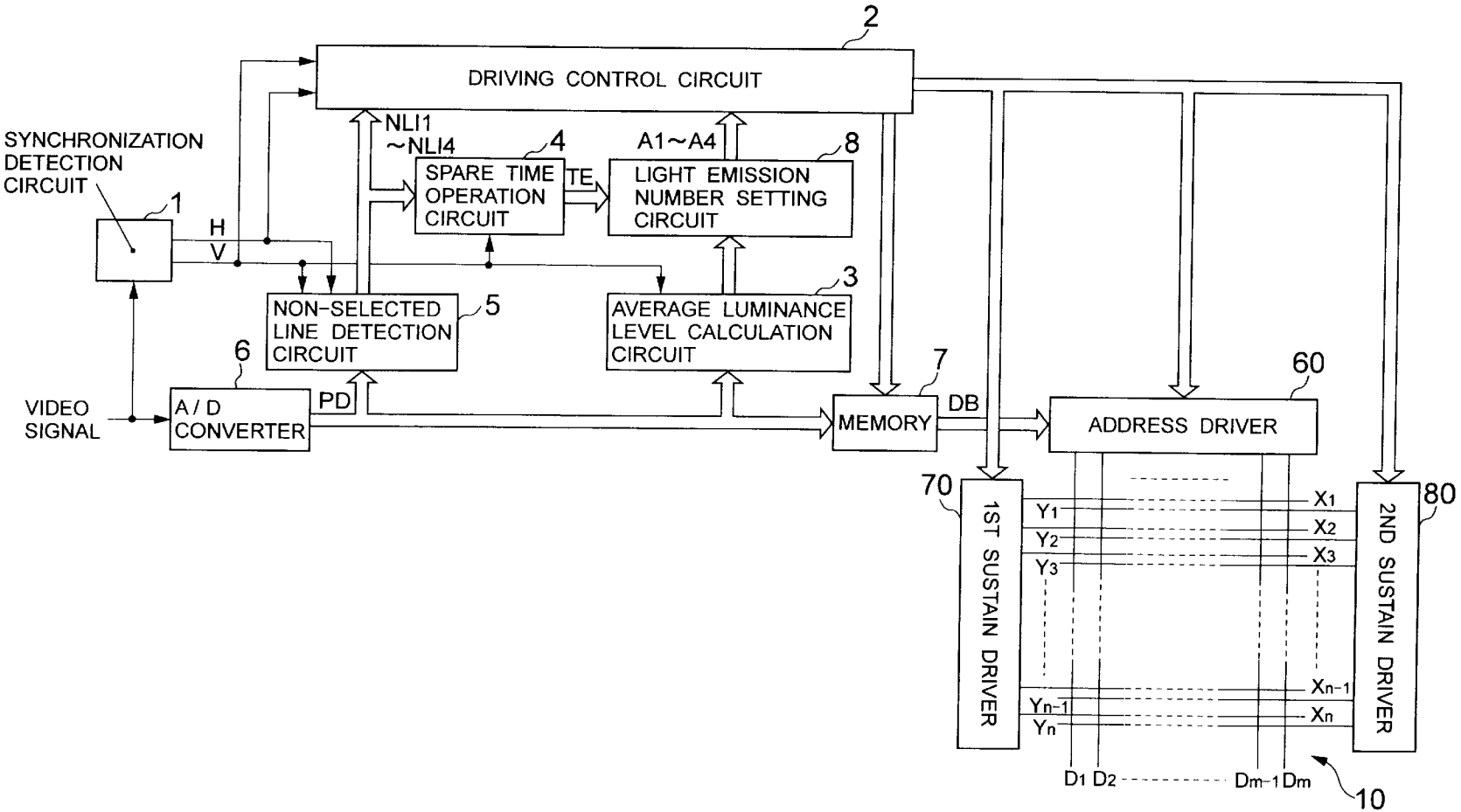
FIG. 2 is a diagram of the general configuration of a plasma display device according to the present invention.

FIG. 2 is a diagram of the general configuration of a plasma display device according to the present invention.

Figure 1:
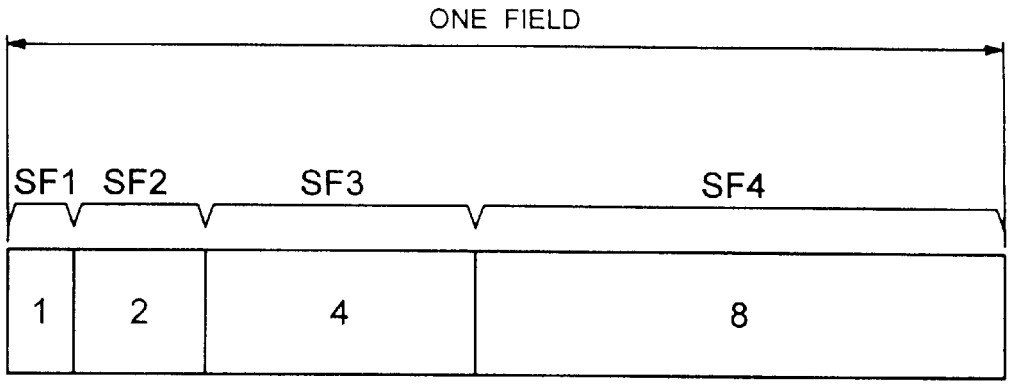
FIG. 1 is a light emission driving format based on a subfield drive method.

As shown in FIG. 2, the plasma display device includes a PDP (plasma display panel) 10, and various functional modules to drive the PDP. Note that according to the embodiment as will be described, the display period for one field is divided into periods corresponding to four subfields SF1 to SF4 as shown in FIG. 1 based on the subfield drive method, and gradation driving is performed.

In FIG. 2, the PDP 10 includes m column electrodes $D_1$ to $D_m$ as address electrodes, n row electrodes $X_1$ to $X_n$ and n row electrodes $Y_1$ to $Y_n$. The row electrodes are arranged so that they intersect the column electrodes. One pair of row electrodes, X and Y, forms a row electrode corresponding to one display line in the PDP 10. The discharge spaces, with discharge gas enclosed, are provided between the column electrodes D, and the row electrodes X and Y. A discharge cell is formed at each intersection of the row electrode pairs and the column electrodes including the discharge spaces. More specifically, there are m discharge cells on one display line, and there are m×n discharge cells on one screen page region.

A synchronization detection circuit 1 detects a vertical synchronization signal in an input video signal and generates a vertical synchronization detection signal V. The signal is supplied to a driving control circuit 2, an average luminance level calculation circuit 3, a spare time operation circuit 4, and a non-selected line detection circuit 5. The synchronization detection circuit 1 also detects a horizontal synchronization signal in the input video signal and generates a horizontal synchronization detection signal H which is supplied to the driving control circuit 2 and the non-selected line detection circuit 5. An A/D converter 6 samples and converts the input video signal into 4-bit pixel data PD on a pixel basis for example, and supplies the data to the average luminance level calculation circuit 3, the non-selected line detection circuit 5 and a memory 7. The average luminance level calculation circuit 3 calculates the average luminance level of the input video signal for each field based on the pixel data PD supplied from the A/D converter 6, and supplies the resultant average luminance level to a light emission number setting circuit 8.

The non-selected line detection circuit 5 detects, for each subfield, a display line on which all the discharge cells are not subjected to selective discharge which will be described based on the pixel data PD. In other words the circuit detects a non-selected line. The non-selected line detection circuit 5 supplies the result of detection as non-selected line information NLI1 to NLI4 for subfields SF1 to SF4 respectively, to the driving control circuit 2 and the spare time operation circuit 4.

Figure 3:
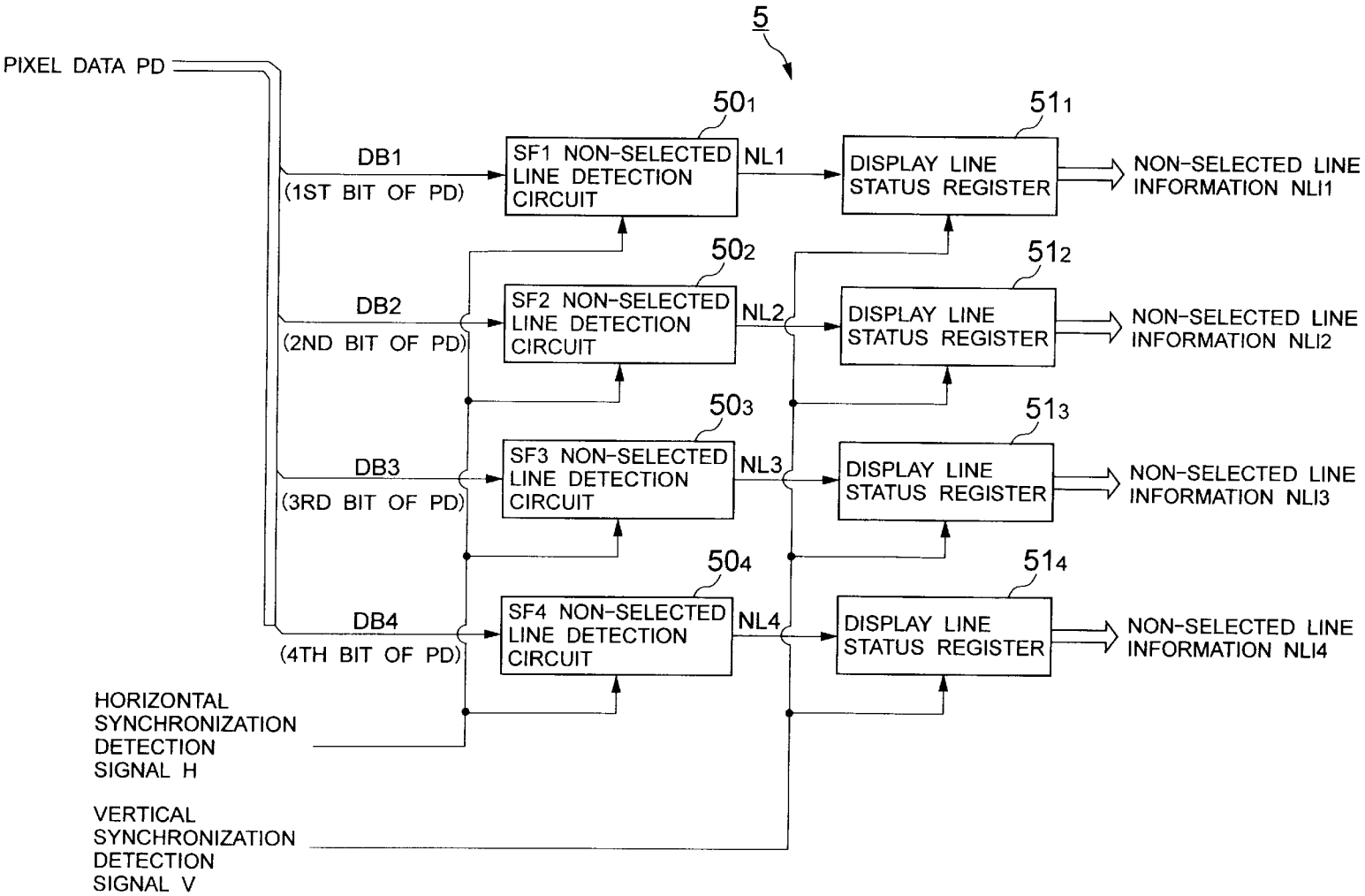
FIG. 3 is a diagram showing the internal structure of a non-selected line detection circuit 5.

FIG. 3 is a diagram of the internal structure of the non-selected line detection circuit 5.

In FIG. 3, an SF1 non-selected line detection circuit $50_1$ sequentially takes only the first bit data in the 4-bit pixel data PD (hereinafter referred to as "pixel data bit DB1"). The SF1 non-selected line detection circuit $50_1$ determines whether or not all the m pixel data bits DB1 corresponding to each display line have a value representing a "non-selected" state such as a logical level "0". Note that the "non-selected" state refers to the state in which selective erasure discharge is not caused in the case of selective erasure addressing, whereas the term refers to the state in which selective writing discharge is not caused in the case of selective writing addressing. Then, the SF1 non-selected line detection circuit $50_1$ supplies a non-selected line detection signal NL1 in a logical level "1" to a display line status register $51_1$ if all the m pixel data bits DB1 have a value representing the "non-selected" state. The signal in this logical level indicates that the display line is a non-selected line in the subfield SF1. Meanwhile, the SF1 non-selected line detection circuit $50_1$ supplies the non-selected line detection signal NL1 in a logical level "0" to the display line status register $51_1$ if all the pixel data bits DB1 do not have a value representing the "non-selected" state.

More specifically, the SF1 non-selected line detection circuit $50_1$ sequentially obtains the non-selected line detection signal NL1 corresponding to each of the first to nth display lines for each horizontal synchronization detection signal H, and supplies the signal to the display line status register $51_1$.

Figure 4:
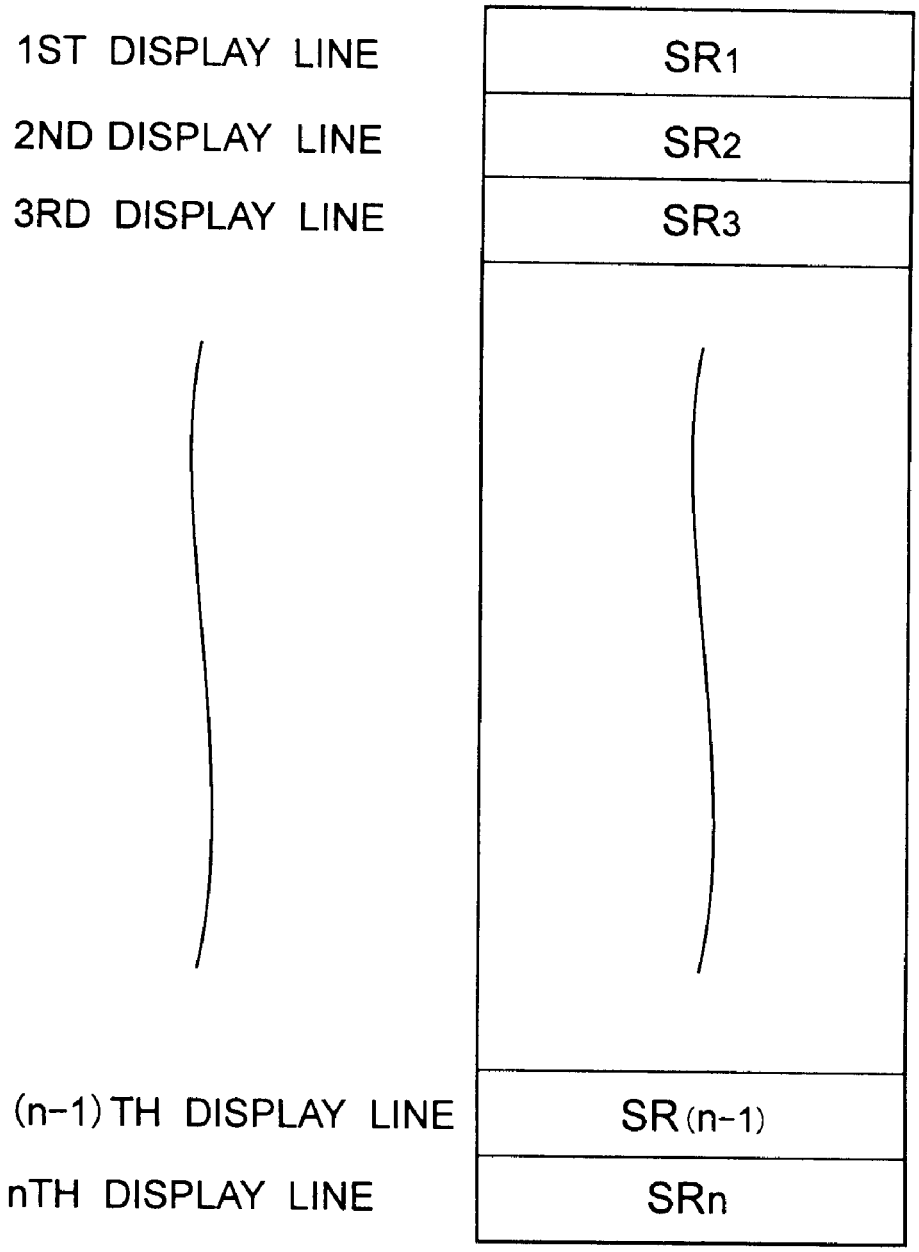
FIG. 4 is a diagram of the structure of a display line status register 51.

As shown in FIG. 4, the display line status register $51_1$ includes status registers $SR_1$ to $SR_n$ corresponding to the first to nth display lines respectively, in the PDP 10. The display line status register $51_1$ sequentially writes the value of the non-selected line detection signal NL1 supplied from the SF1 non-selected line detection circuit $50_1$ to a status register SR corresponding to the display line. The display line status register $51_1$ reads out the values written in the status registers $SR_1$ to $SR_n$ in response to the vertical synchronization detection signal V. It then supplies the values to the driving control circuit 2 and the spare time operation circuit 4 as the non-selected line information NLI1, indicating a non-selected line in the subfield SF1.

An SF2 non-selected line detection circuit $50_2$ sequentially takes only the second bit data in the 4-bit pixel data PD (hereinafter referred to as "pixel data bit DB2"). The SF2 non-selected line detection circuit $50_2$ determines whether or not all the m pixel data bits DB2 corresponding to each display line have a value representing the "non-selected" state such as a logical level "0". Then, if all the m pixel data bits DB2 have a value representing the "non-selected" state, the SF2 non-selected line detection circuit $50_2$ supplies a non-selected line detection signal NL2 in a logical level "1" to a display line status register $51_2$ The signal in the logical level indicates that the display line is a non-selected line in the subfield SF2. Meanwhile, the SF2 non-selected line detection circuit $50_2$ supplies the non-selected line detection signal NL2 in a logical level "0" to the display line status register $51_2$ if all the pixel data bits DB2 do not have such a value representing the "non-selected" state.

More specifically, the SF2 non-selected line detection circuit $50_2$ sequentially obtains the non-selected line detection signal NL2 corresponding to the first to nth display lines for each horizontal synchronization detection signal H, and supplies the obtained signal to the display line status register $51_2$.

As shown in FIG. 4, the display line status register $51_2$ includes status registers $SR_1$ to $SR_n$ corresponding to the first to nth display lines respectively, in the PDP 10. The display line status register $51_2$ sequentially writes the value of the non-selected line detection signal NL2 to a status register SR corresponding to the display line. The display line status register $51_2$ reads the values written in the status registers $SR_1$ to $SR_n$ in response to the vertical synchronization detection signal V, and supplies the values to the driving control circuit 2 and the spare time operation circuit 4 as non-selected line information NLI2 representing a non-selected line in the subfield SF2.

An SF3 non-selected line detection circuit $50_3$ sequentially takes only the third bit data in the 4-bit pixel data PD (hereinafter referred to as "pixel data bit DB3"). The SF3 non-selected line detection circuit $50_3$ determines whether or not all the m pixel data bits DB3 corresponding to each display line have a value representing the "non-selected" state such as a logical level "0". Then, if all the m pixel data bits DB3 have a value representing the "non-selected" state, the SF3 non-selected line detection circuit $50_3$ supplies a non-selected line detection signal NL3 in a logical level "1"

to a display line status register $51_3$. The signal in the logical state indicates that the display line is a non-selected line in the subfield SF3. Meanwhile, the SF3 non-selected line detection circuit $50_3$ supplies a non-selected line detection signal NL3 in a logical level "0" to the display line status register $51_3$ if all the pixel data bits DB3 do not have such a value representing the "non-selected" state.

More specifically, SF3 non-selected line detection circuit $50_3$ sequentially obtains the non-selected line detection signal NL3 corresponding to the first to nth display lines for each horizontal synchronization detection signal H, and supplies the obtained signal to the display line status register $51_3$.

As shown in FIG. 4, the display line status register $51_3$ includes status registers $SR_1$ to $SR_n$ corresponding to the first to nth display lines respectively, in the PDP 10. The display line status register $51_3$ sequentially writes the value of the non-selected line detection signal NL3 to a status register SR corresponding to the display line. The display line status register $51_3$ reads the values written in the status registers $SR_1$ to $SR_n$ in response to the vertical synchronization detection signal V, and supplies the values to the driving control circuit 2 and the spare time operation circuit 4 as non-selected line information NLI3 representing a non-selected line in the subfield SF3.

An SF4 non-selected line detection circuit $50_4$ sequentially takes only the fourth bit data in the 4-bit pixel data PD (hereinafter referred to as "pixel data bit DB4"). The SF4 non-selected line detection circuit $50_4$ determines whether or not all the m pixel data bits DB4 corresponding to each display line have a value representing the "non-selected" state such as a logical level "0". Then, if all the m pixel data bits DB4 have a value representing the "non-selected" state, the SF4 non-selected line detection circuit $50_4$ supplies a non-selected line detection signal NL4 in a logical level "1" to a display line status register $51_4$. The signal in this level indicates that the display line is a non-selected line in the subfield SF4. Meanwhile, the SF4 non-selected line detection circuit $50_4$ supplies the non-selected line detection signal NL4 in a logical level "0" to the display line status register $51_4$ if all the pixel data bits DB4 do not have such a value representing the "non-selected" state.

More specifically, the SF4 non-selected line detection circuit $50_4$ sequentially obtains the non-selected line detection signal NL4 corresponding to the first to nth display lines for each horizontal synchronization detection signal H, and supplies the obtained signal to the display line status register $51_4$.

As shown in FIG. 4, the display line status register $51_4$ includes status registers $SR_1$ to $SR_n$ corresponding to the first to nth display lines in the PDP 10. The display line status register $51_4$ sequentially writes the value of the non-selected line detection signal NL4 to a status register SR corresponding to the display line. The display line status register $51_4$ reads out the values written in the status registers $SR_1$ to $SR_n$ in response to the vertical synchronization detection signal V. It then supplies the values to the driving control circuit 2 and the spare time operation circuit 4 as non-selected line information NLI4 representing a non-selected line in the subfield SF4.

The spare time operation circuit 4 obtains the total number of non-selected lines in each of the subfields SF1 to SF4 indicated by the non-selected line information NLI1 to NLI4 supplied from the non-selected line detection circuit 5, and supplies the total number to the light emission number setting circuit 8 as spare time TE.

The light emission number setting circuit 8 sets a luminance magnification K within the range satisfying the following relation:

$$K\cdot(a1+a2+a3+a4)-(a1+a2+a3+a4)=TE$$

where a1 to a4 are reference light emission numbers allocated to the subfields SF1 to SF4 respectively, and TE is spare time.

If for example an externally applied, luminance adjusting instruction directs a reduction in the luminance, the luminance magnification K is set to a value smaller than "1". Meanwhile, if the luminance adjusting instruction directs an increase in the luminance, the luminance magnification K is set to a value larger than "1" within the range satisfying the above expression. The light emission number setting circuit 8 sets the luminance magnification K to a value larger than "1" within the range satisfying the above expression if an average luminance level supplied from the average luminance level calculation circuit 3 is smaller than a prescribed level. If the average luminance level is higher than the prescribed level, the luminance magnification K is set to a value smaller than "1".

The light emission number setting circuit 8 multiplies each of the reference light emission numbers a1 to a4 by the luminance magnification K to produce the final light emission numbers A1 to A4, allocated to the subfields SF1 to SF4 as follows:

A1=K·a1 the number of light emission in SF1

A2=K·a2 the number of light emission in SF2

A3=K·a3 the number of light emission in SF3

A4=K·a4 the number of light emission in SF4

Then, these numbers and the luminance magnification K are supplied to the driving control circuit 2.

The memory 7 is sequentially written with the pixel data PD supplied from the A/D converter 6 in response to a writing signal supplied from the driving control circuit 2. When data for one screen page, in other words n×m pixel data pieces from pixel data $PD_{11}$ corresponding to the pixel in the first row and the first column to $PD_{nm}$ corresponding to the pixel in the nth row and the mth column, has been written, the memory 7 performs the following reading operation.

The first bit data of the pixel data $PD_{11}$ to $PD_{nm}$ is read out from the memory 7 as driving pixel data bits $DB1_{11}$ to $DB1_{nm}$ on a display line basis in response to a reading address supplied from the driving control circuit 2 and supplied to the address driver 60. Then, the second bit data of the pixel data $PD_{11}$ to $PD_{nm}$ is read out from the memory 7 as driving pixel data bits $DB2_{11}$ to $DB2_{nm}$ on a display line basis in response to a reading address supplied from the driving control circuit 2. The read out data is supplied to the address driver 60. Then, the third bit data of the pixel data $PD_{11}$ to $PD_{nm}$ is read out from the memory 7 as driving pixel data bits $DB3_{11}$ to $DB3_{nm}$ on a display line basis in response to a reading address supplied from the driving control circuit 2. The read out data is supplied to the address driver 60. Then, the fourth bit data of the pixel data $PD_{11}$ to $PD_{nm}$ is read out from the memory 7 as driving pixel data bits $DB4_{11}$ to $DB4_{nm}$ on a display line basis in response to a reading address supplied from the driving control circuit 2. The read out data is supplied to the address driver 60.

Note, however, that during the period the driving control circuit 2 does not produce a reading address for a driving pixel data bit DB corresponding to a non-selected line indicated by the non-selected line information NLI1 to NLI4. More specifically, a driving pixel data bit DB corresponding to a non-selected line is not read out from the memory 7.

The driving control circuit 2 operates in a light emission driving format based on the luminance magnification K, the light emission numbers A1 to A4 supplied from the light emission number setting circuit 8, and the non-selected line information NLI1 to NLI4. According to the light emission driving format, various timing signals used for gradation driving of the PDP 10 are supplied to the address driver 60, and the first and second sustain drivers 70 and 80.

Figure 5A:
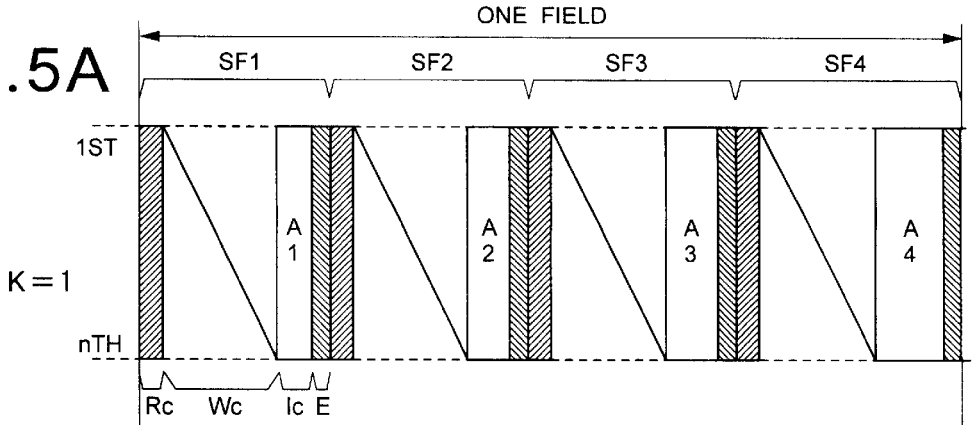
FIGS. 5A to 5C are a light emission driving format used in the plasma display device shown in FIG. 2.

The driving control circuit 2, for example, operates in a light emission driving format, shown in FIG. 5A, when the non-selected line information NLI1 to NLI4 indicate the absence of a non-selected line in any of the subfields SF1 to SF4, and the luminance magnification K is "1".

As shown in FIG. 5A, according to the light emission driving format, the simultaneous reset step Rc, the pixel data writing step Wc, the light emission sustaining step Ic and the erasure step E are executed in each subfield.

Figure 6:
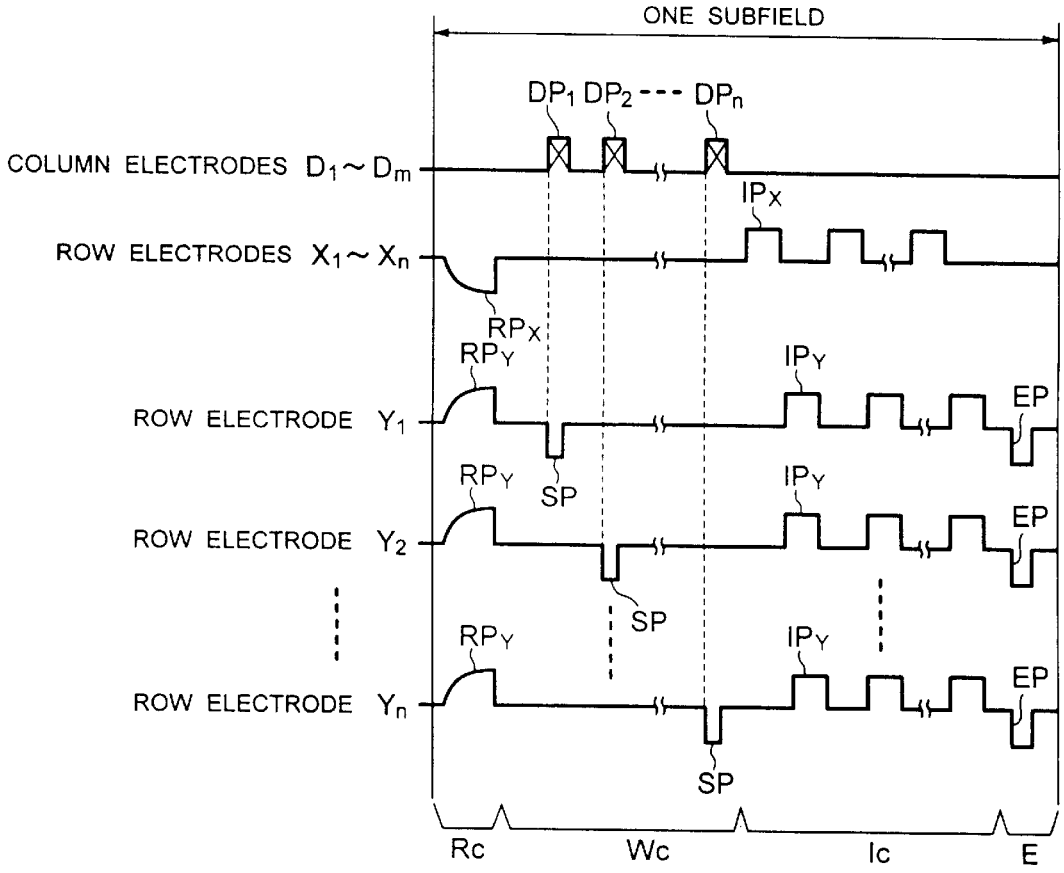
FIG. 6 is a timing chart showing various driving pulses applied to the PDP 10 according to the light emission driving format shown in FIG. 5A, and the application timings of the pulses.

FIG. 6 shows various driving pulses applied by the address driver 60 and the first and second sustain drivers 70 and 80 to the column electrodes and the row electrode pairs in the PDP 10 in the light emission driving format shown in FIG. 5A. Note that FIG. 6 shows only the timings in one subfield in FIG. 5A.

In the simultaneous reset step Rc, the first and second sustain drivers 70 and 80 at a certain time apply a reset pulse $RP_X$ of negative polarity and a reset pulse $RP_Y$ of positive polarity respectively, to the row electrodes X and Y in the PDP 10. In response to the application of these reset pulses $RP_X$ and $RP_y$; all the discharge cells in the PDP 10 are reset-discharged, and a prescribed quantity of wall charges are homogeneously formed in each discharge cell. Thus, all the discharge cells at once are initialized to the "light emitting" state to emit light.

Then in the pixel data writing step Wc, the address driver 60 produces a pixel data pulse having a voltage corresponding to the logical level of a driving pixel data bit DB read out from the memory 7. At the same time, all the driving pixel data bits DB belonging to the first to nth display lines are read out from the memory 7. As shown in FIG. 6, the address driver 60 applies the pixel data pulses to the column electrodes $D_1$ to $D_m$ as pixel data pulse groups $DP_1$ to $DP_n$. These are grouped on a display line basis sequentially from the pulse belonging to the first display line to the one belonging to the nth display line. Note that the address driver 60 produces a high voltage pixel data pulse when the logical level of the driving pixel data bit DB is "1", and a low voltage (0V) pixel data pulse when the logical level is "0".

In the pixel data writing step Wc, the driving control circuit 2 supplies the second sustain driver 80 with a timing signal used to apply a scanning pulse SP only to display lines other than non-selected lines. In this case, since there is no non-selected line in any of the subfields SF1 to SF4, the driving control circuit 2 supplies the second sustain driver 80 with the timing signal used to apply the scanning pulse SP to all the display lines. As a result, as shown in FIG. 6, the second sustain driver 80 sequentially applies the scanning pulse SP of negative polarity to the row electrodes $Y_1$ to $Y_n$ the same timings as the application timings to all the pixel data pulse groups $DP_1$ to $DP_n$.

In the pixel data writing step Wc, only a discharge cell located at the intersection of a "row" provided with the scanning pulse SP and a "column" provided with a high voltage pixel data pulse is discharged (selective erasure discharge), so that wall charges formed in the discharge cell are removed. By the selective erasure discharge, a discharge cell which has been initialized to the "light emitting" state in the simultaneous reset step Rc attains a "non-light emitting" state which allows no light emission. Meanwhile, a discharge cell provided with a low voltage pixel data pulse is not subjected to the selective erasure discharge as described above, and the initialized state in the simultaneous reset step Rc. In other words, the "light emitting" state is maintained.

In the following light emission sustaining step Ic, as shown in FIG. 6, the first and second sustain drivers 70 and 80 alternately apply sustain pulses $IP_X$ and $IP_Y$ of positive polarity to the row electrodes $X_1$ to $X_n$ and $Y_1$ to $Y_n$. In this case, in the light emission sustaining step Ic in each of the subfields SF1 to SF4, the number of sustain pulses applied by the first and second sustain drivers 70 and 80 is as follows. The light emission numbers A1 to A4 are supplied from the light emission number setting circuit 8.

A1: SF1

A2: SF2

A3: SF3

A4: SF4

By the light emission sustaining step Ic, a discharge cell with remaining wall charges, in other words a "light emitting" cell, is subjected to sustaining discharge each time the sustain pulses $IP_X$ and $IP_Y$ are applied, and the light emitting state by the sustaining discharge is maintained for the above number of times (periods).

In the erasure step E at the end of each subfield, the second sustain driver 80 applies an erasure pulse EP, as shown in FIG. 6, to the row electrodes $Y_1$ to $Y_n$, so that all the discharge cells are simultaneously erasure-discharged. Thus, all the wall charges remaining in each of the discharge cells are removed.

The series of operations i.e., the simultaneous reset step Rc, the pixel data writing step Wc, the light emission sustaining step Ic and the erasure step E are similarly performed in each subfield.

FIG. 7 is a table showing light emission patterns for the pixel data PD by the driving operation as described above.

In FIG. 7, when for example a video signal (corresponding to pixel data "1110") having a luminance level corresponding to the ninth gradation is input, light is emitted only in the light emission sustaining step Ic in the subfield SF4 among the subfields SF1 to SF4. More specifically, in the pixel data writing step Wc in each of the subfields SF1 to SF3, selective erasure discharge is caused to remove wall charges in discharge cells. Meanwhile, in the pixel data writing step Wc in the subfield SF4, the selective erasure discharge is not caused, and therefore wall charges remain. As a result, only by the light emission sustaining step Ic in the subfield SF4, sustaining discharge with light emission is performed as many times (periods) as the number of application of the sustaining pulses $IP_X$ and $IP_Y$. In other words the sustaining discharge is performed "a4" times (periods). Thus, during the display period for one field, light is emitted "a4" times (periods), and the display in the luminance level corresponding to the ninth gradation is provided.

When a video signal in a luminance level corresponding to the sixth gradation (corresponding to pixel data "0101") is input, light is emitted only in the light emission sustaining step Ic in each of the subfields SF1 and SF3 among the subfields SF1 to SF4. Therefore, sustaining discharge with light emission is caused "a1" times (periods) in the light emission sustaining step Ic in the subfield SF1, and "a3" times (periods) in the light emission sustaining step Ic in the subfield SF3. As a result, light is emitted "(a1+a3)" times (periods) during the display period for one field, so that the display in the luminance level corresponding to the sixth gradation is provided.

Figure 5B:
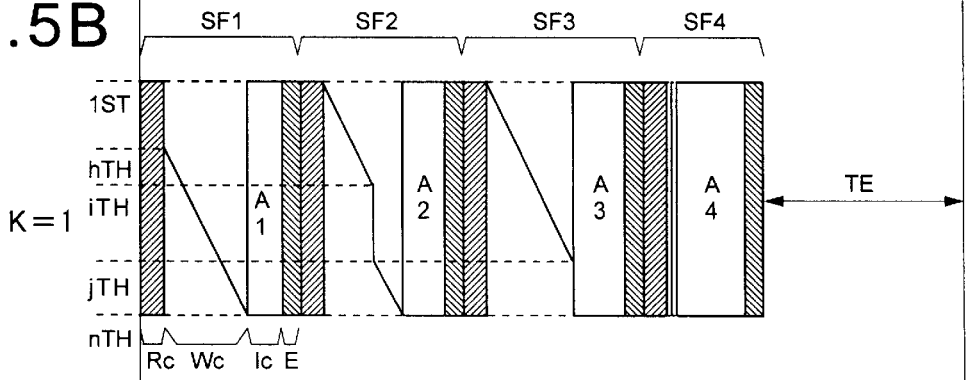

Meanwhile, the driving control circuit 2 operates in a light emission driving format, shown in FIG. 5B, if the non-selected line information NLI1 to NLI4 indicates the presence of a non-selected line in any of the subfields SF1 to SF4, and the luminance magnification K is "1".

Note that FIG. 5B shows an example of a light emission format employed when the non-selected line in each subfield corresponds to the following:

SF1: the first display line to (h−1)th display line

SF2: the ith display line to (j−1)th display line

SF3: the jth display line to nth display line

SF4: all the display lines

Figure 8:
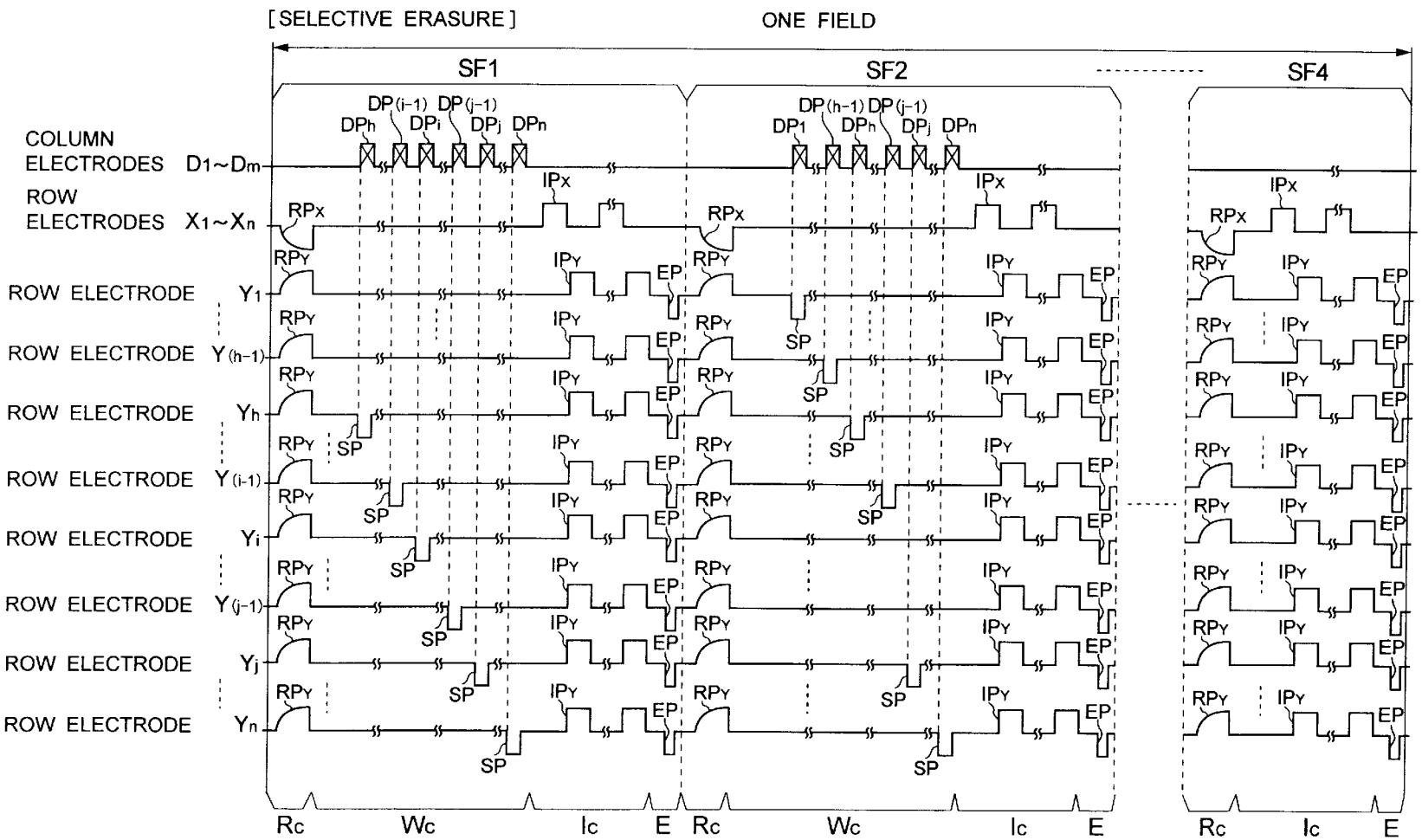
FIG. 8 is a timing chart showing various driving pulses applied to the PDP 10 according to the light emission driving format shown in FIG. 5B, and the application timings of the pulses (by selective erasure addressing)

FIG. 8 is a chart showing the application timings of various driving pulses to the column electrodes and the row electrode pairs in the PDP 10 by the address driver 60, and the first and second sustain drivers 70 and 80 based on the light emission driving format shown in FIG. 5B.

Note that in FIG. 8, the operations in the simultaneous reset step Rc, the light emission sustaining step Ic and the erasure step E are the same as those shown in FIG. 6, and therefore only the operation in the pixel data writing step Wc will now be described.

In FIG. 8, in the pixel data writing step Wc in the subfield SF1, the address driver 60 produces a pixel data pulse having voltage corresponding to the logical level of a driving pixel data bit DB read out from the memory 7. Note that the address driver 60 produces a high voltage pixel data pulse when the logical level of the driving pixel data bit DB is "1", and a low voltage (0V) pixel data pulse when the logical level is "0". In this case, as described above, in the subfield SF1, the first to (h−1)th display lines are non-selected lines among the first to nth display lines, and therefore only driving pixel data bits DB belonging to the hth to nth display lines are read out from the memory 7. As a result, as shown in FIG. 8, the address driver 60 sequentially applies pixel data pulse group $DP_h$, consisting of m pixel data pulses belonging to the hth display line, to pixel data pulse group $DP_n$, belonging to the nth display line, to the column electrodes $D_1$ to $D_m$. The second sustain driver 80 sequentially applies a scanning pulse SP of negative polarity, as shown in FIG. 8, to the row electrodes $Y_h$ to $Y_n$ in the same application timings as the pixel data pulse groups $DP_h$ to $DP_n$, respectively. Thus, only discharge cells at the intersections of the "rows" provided with the scanning pulse SP and the "columns" provided with the high voltage pixel data pulses are discharged (selective erasure discharge), and wall charges formed in the discharge cells are removed. More specifically, only the discharge cells subjected to the selective erasure discharge attain a "non-light emitting" state, and the discharge cells not subjected to the selective erasure discharge maintain the "light emitting" state.

As described above, in the pixel data writing step Wc in the subfield SF1, pixel data writing scanning is performed as shown in FIG. 8 only to the hth to nth display lines excluding the non-selected, first to (h−1)th display lines. In this case, the scanning pulse SP and the pixel data pulse group DP are not provided to the non-selected, first to (h−1)th display lines, so that these lines are skipped in the writing scanning.

In the pixel data writing step Wc in the subfield SF2, as shown in FIG. 8, the address driver 60 produces a pixel data pulse having a voltage corresponding to the logical level of a driving pixel data bit DB read out from the memory 7. Note that the address driver 60 produces a high voltage pixel data pulse when the logical level of the driving pixel data bit DB is "1" and a low voltage (0V) pixel data pulse when the logical level is "0". In this case, as described above, in the subfield SF2, the ith to (j−1)th display lines among the first to nth display lines are non-selected lines. Therefore, only the driving pixel data bits DB belonging to the first to (i−1)th display lines and the jth to nth display lines are read out from the memory 7. As a result, as shown in FIG. 8, the address driver 60 sequentially applies pixel data pulse group $DP_1$, belonging to the first display line, to pixel data pulse group $DP_{i-1}$, belonging to the (i−1)th display line, to the column electrodes $D_1$ to $D_m$. Then, the address driver 60 skips the ith to (j−1)th display lines and sequentially applies pixel data pulse group $DP_j$, belonging to the jth display line, to pixel data pulse group $DP_n$, belonging to the nth display line, to the column electrodes $D_1$ to $D_m$ as shown in FIG. 8. Here, the second sustain driver 80 sequentially applies the scanning pulse SP of negative polarity, as shown in FIG. 8, to the row electrodes $Y_h$ to $Y_n$ in the same application timings as those of the pixel data pulse groups $DP_1$ to $DP_{i-1}$ and the pixel data pulse groups $DP_j$ to $DP_n$. Thus, only the discharge cells at the intersections of the "rows" provided with the scanning pulse SP and the "columns" provided with the high voltage pixel data pulses are discharged (selective erasure discharge), and wall charges formed in the discharge cells are removed. More specifically, only the discharge cells subjected to the selective erasure discharge attain a "non-light emitting" state, and the discharge cells not subjected to the selective erasure discharge maintain the "light emitting" state.

As described above, in the pixel data writing step Wc in the subfield SF2, the pixel data writing scanning as shown in FIG. 8 is performed only to display lines excluding the non-selected ith to (j−1)th display lines. At the same time, the non-selected ith to (j−1)th display lines are not provided with the scanning pulse SP and the pixel data pulse group DP and thus skipped in the writing scanning. In the pixel data writing step Wc in the subfields SF3 and SF4, similar to the operations described above, pixel data writing scanning is performed only to the display lines excluding the non-selected lines. In the embodiment shown in FIG. 8, since all the display lines are non-selected lines in the subfield SF4, the pixel data writing scanning, as described above, is not performed. The non-selected lines are not provided with the scanning pulse SP and the pixel data pulse group DP and thus skipped in the writing scanning.

As described above, according to the present invention, non-selected lines are detected for each subfield and pixel data writing scanning is performed only to the display lines other than the non-selected lines. As a result, the time required for each pixel data writing step Wc is reduced by the time saved by skipping the non-selected lines in the pixel data writing scanning, and spare time TE as shown in FIG. 5B is produced. According to the present invention, the luminance magnification K can be set to a value larger than "1" using the spare time TE. Therefore, when the luminance level of the entire screen is automatically adjusted based on the average luminance level of one screen page, a light emission number larger than the preset reference light emission numbers a1 to a4 can be set for each subfield.

Figure 5C:
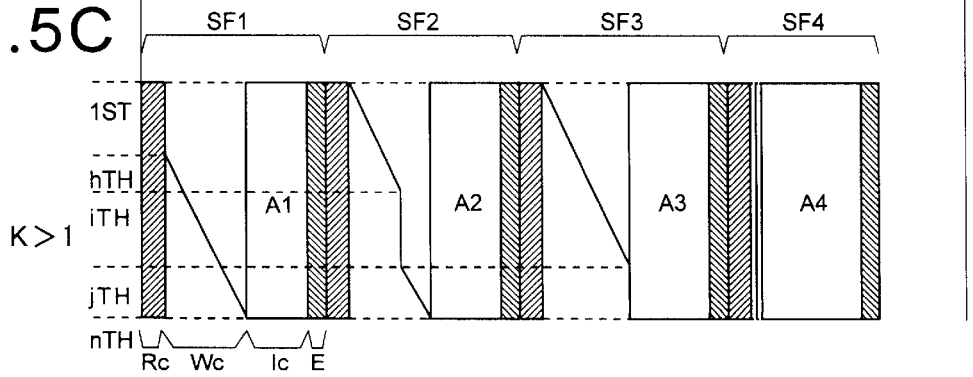

FIG. 5C shows a light emission driving format for the driving control circuit 2 when the luminance magnification K is set to a value larger than "1" under the condition of the light emission driving format shown in FIG. 5B.

By driving as shown in FIG. 5C, the number of light emissions performed in the light emission sustaining step Ic in each of the subfields SF1 to SF4 is produced by multiplying the reference light emission numbers a1 to a4 by K (K>1), and therefore a higher luminance display than the driving, as shown in FIG. 5B, is provided. More specifically, according to the present invention, using the spare time TE created within the display period for one field, the number of light emissions (light emission periods) to be allocated to each light emission sustaining step can be increased, so that a higher luminance display can be provided on the entire screen.

Note that in the above described embodiment, wall charges are previously formed in all the discharge cells and selectively erased based on pixel data, in other words, a so-called selective erasure addressing method is employed as a pixel data writing method.

However, according to the present invention, a so-called selective writing addressing method may be applied as a pixel data writing method and wall charges can selectively be formed based on pixel data.

Figure 9:
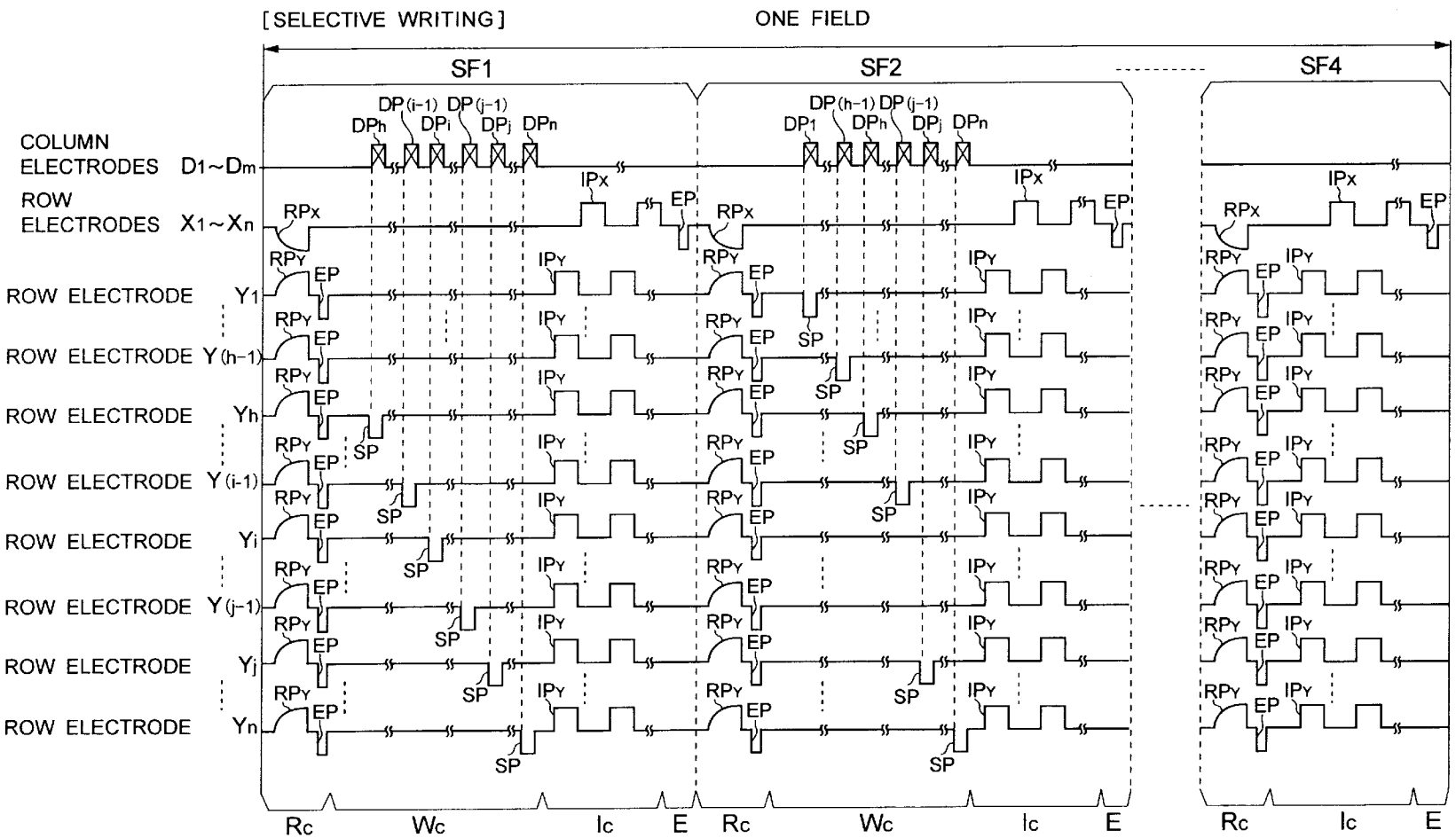
FIG. 9 is a timing chart showing various driving pulses applied to the PDP 10 according to the light emission driving format shown in FIG. 5B and the application timings of the pulses (by selective writing addressing).

FIG. 9 is a chart showing the application timings of various driving pulses to the column electrodes and the row electrode pairs in the PDP 10 by the address driver 60, and the first and second sustain driver 70 and 80 when the selective writing addressing method is employed. FIG. 9 shows various driving pulses applied when gradation driving based on the light emission driving format shown in FIG. 5B is performed, and the application timings of the pulses.

In FIG. 9, at a certain time during the simultaneous reset step Rc performed at the head of the subfields SF1 to SF4, the first sustain driver 70 applies a reset pulse $RP_X$ of negative polarity to all the row electrodes $X_1$ to $X_n$ in the PDP 10. At the same time, the second sustain driver 80 applies a reset pulse $RP_Y$ of positive polarity to all the row electrodes $Y_1$ to $Y_n$. In response to the application of these reset pulses $RP_X$ and $RP_Y$, all the discharge cells in the PDP 10 are reset-discharged, and a prescribed quantity of wall charges are equally formed in the discharge cells. Immediately after this, the second sustain driver 80 simultaneously applies an erasure pulse EP to the row electrodes $Y_1$ to $Y_n$. The application of the erasure pulse EP causes erasure discharge and as a result the wall charges formed in all the discharge cells are removed. More specifically, in the simultaneous reset step Rc when the selective writing addressing method, as shown in FIG. 9, is employed, all the discharge cells in the PDP 10 are initialized to the "non-light emitting" state.

In the pixel data writing step Wc in the subfields SF1 to SF4, the address driver 60 produces a pixel data pulse with a voltage corresponding to the logical level of a driving pixel data bit DB read out from the memory 7. Note that the address driver 60 produces a high voltage pixel data pulse when the logical level of the driving pixel data bit DB is "1" whereas it produces a low voltage (0V) pixel data pulse when the logical level is "0". At the time, in the subfield SF1, for example, the first to (h−1)th display lines are non-selected lines among the first to nth display lines. Therefore, only the driving pixel data bits DB belonging to the hth to nth display lines are read out from the memory 7. As a result, in the pixel data writing step Wc in the subfield SF1, as shown in FIG. 9, the address driver 60 sequentially applies pixel data pulse group $DP_h$ of m pixel data pulses, belonging to the hth display line, to pixel data pulse group $DP_n$, belonging to the nth display line, to the column electrodes $D_1$ to $D_m$. During the operation, the second sustain driver 80 sequentially applies the scanning pulse SP of negative polarity, as shown in FIG. 9, to the row electrodes $Y_h$ to $Y_n$ in the same application timings as those of the pixel data pulse groups DP. Thus, only the discharge cells at the intersections of the "rows" provided with the scanning pulse SP and the "columns" provided with the high voltage pixel data pulses are discharged (selective writing discharge), and wall charges are formed in the discharge cells. More specifically, only the discharge cells subjected to the selective writing discharge are set to the "light emitting" state, and the discharge cells not subjected to the selective writing discharge maintain the "non-light emitting" state.

Then, in the light emission sustaining step Ic in the subfields SF1 to SF4, similar to the case of the selective erasure addressing method, the first and second sustain drivers 70 and 80 alternately apply the sustain pulses $IP_X$ and $IP_Y$ of positive polarity to the row electrodes $X_1$ to $X_n$ and $Y_1$ to $Y_n$, as shown in FIG. 8. At the same time, in the light emission sustaining step Ic in the subfields SF1 to SF4, the number of sustain pulses applied by the first and second sustain drivers 70 and 80 is based on the light emission numbers A1 to A4 supplied from the light emission number setting circuit 8, as follows.

A1: SF1
A2: SF2
A3: SF3
A4: SF4

The light emission sustaining step Ic allows the discharge cells having the remaining wall charges, in other words the "light emitting cells", to be discharged every time the sustain pulses $IP_X$ and $IP_Y$ are applied. The light emitting state associated with the sustaining discharge is maintained for as many times (periods) as the number of applications.

At a certain time in the erasure step E at the end of each subfield, the first sustain driver 70 applies the erasure pulse EP, as shown in FIG. 9, to the row electrodes $X_1$ to $X_n$. Thus, all the discharge cells are simultaneously erasure-discharged, and all the wall charges remaining in the discharge cells are removed.

As described above, by the selective writing addressing method, pixel data writing scanning is performed only to the display lines other than the non-selected lines for each field. As a result the time required for each pixel data writing step is shortened.

Note that when the selective writing addressing method is employed, and there are a plurality of light emitting lines with discharge cells all in the "light emitting" state, these lines may simultaneously be subjected to selective writing discharge. Consequently the pixel data writing period is shortened. More specifically, there is a spare time period created corresponding to the reduction in the display period for one field. Similarly, note that when the selective erasure addressing method is employed, and there are a plurality of non-light emitting lines with discharge cells all in the "non-light emitting" state, these lines may simultaneously be subjected to selective erasure discharge. Consequently the pixel data writing period is shortened. More specifically, there is a spare time period created corresponding to the reduction in the display period for one field. Therefore, similar to the above embodiment, the number of light emissions to be performed in the light emission sustaining step in each subfield can be changed using the spare time period.

As in the foregoing, according to the present invention, non-selected lines are detected in each subfield, and only the display lines other than the non-selected lines are subjected to pixel data writing scanning. As a result, the time required for each pixel data writing step can be shortened by the time period otherwise used for the pixel data writing scanning to the non-selected lines. As a result, according to the invention, the spare time created by the reduction in the time period can be used for increasing the number of light emission (light emitting periods) to be allocated in each light emission sustaining step and high luminance display on the entire screen can be achieved.

The present application is based on Japanese Patent Application No. 2000-199899 which is hereby incorporated by reference.

What is claimed is:

1. A plasma display device performing gradation driving to a plasma display panel based on a video signal, said plasma display panel having discharge cells formed at intersections of a plurality of row electrodes corresponding to display lines and a plurality of column electrodes arranged intersecting said row electrodes, comprising:

a driving part, said driving part performing, pixel data writing scanning for scanning each said discharge cell on each display line according to pixel data corresponding to said video signal and causing selective discharge thereby setting each said discharge cell to one of a light emitting state and a non-light emitting state in each of a plurality of subfields forming a display period for one field in said video signal, and light emission sustaining driving for causing sustaining discharge thereby allowing only said discharge cell in said light emitting state to emit light as many times as the number of light emission allocated corresponding to the weight of each said subfield; and a non-selected line detection part for detecting a non-selected line to be a display line on which all said discharge cells are not subjected to said selective discharge based on said pixel data, wherein said driving part performing said pixel data writing scanning only to each said display line excluding said non-selected line;

a spare time operation part for obtaining spare time produced in the display period for one field based on the total number of said non-selected lines detected by said non-selected line detection part, and wherein said driving part changing the number of light emission allocated to each said subfield within the range of said spare time.

2. The plasma display device according to claim 1, further comprising an average luminance level calculation part for calculating an average luminance level based on said pixel data for one field, said driving part changing the number of light emission allocated to each said subfield based on said average luminance level within the range of said spare time.

* * * * *